US005083116A

United States Patent [19]

Judd

[11] Patent Number: 5,083,116

[45] Date of Patent: Jan. 21, 1992

[54] CONTACT SENSING MODULE EMBODYING LOOP POWER SUPPLY AND STATE SENSING FOR RELAYS AND OTHER CONTACTS

[76] Inventor: Daniel R. Judd, 37 Mill St., Burlington, Mass. 01803

[21] Appl. No.: 458,888

[22] Filed: Dec. 29, 1989

[51] Int. Cl.[5] ..... G08B 21/00

[52] U.S. Cl. ..... 340/644; 200/312

[58] Field of Search ..... 340/644, 310 A, 635; 324/418, 415; 250/551; 200/312; 335/17

[56] References Cited

U.S. PATENT DOCUMENTS 4,949,066 8/1990 Reinhardt ..... 340/310 R

FOREIGN PATENT DOCUMENTS 0050417 4/1982 European Pat. Off. .

OTHER PUBLICATIONS

Opto 22, *Microprocessor I/O Systems Catalog.*

*Primary Examiner*—Jin F. Ng

*Assistant Examiner*—Jeffery A. Hofsass

[57] ABSTRACT

A single module for relay, limit switch or related devices for self-powering the set of contacts and sensing the state of the contacts, compatible with Opto 22 and related I/O systems interfacing microprocessors and industrial processes and the like and with further features, if desired, of a single isolation device for both power and signal isolation such as a transformer, preferably employing conversion to D.C. in the tranformer output and optional resonant mode flyback pulses to step up the primary drive voltage.

8 Claims, 2 Drawing Sheets

Figure 1A:
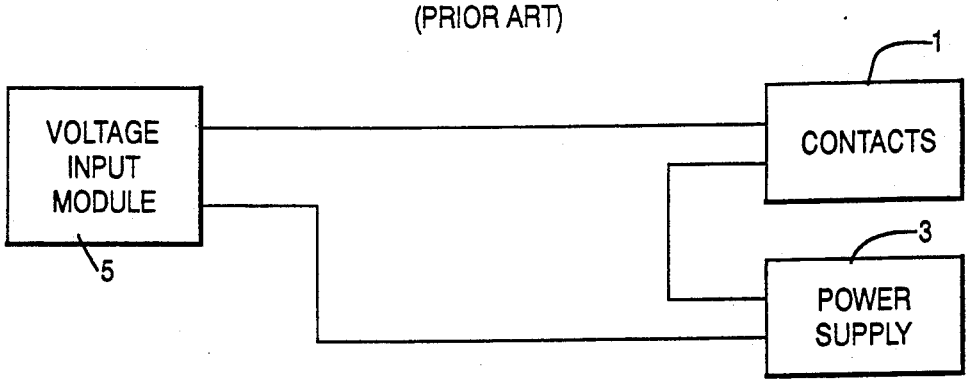
FIG. 1A (PRIOR ART)

CONTACT SENSING MODULE EMBODYING LOOP POWER SUPPLY AND STATE SENSING FOR RELAYS AND OTHER CONTACTS

The present invention relates to contact sensors for relays, limit switches and various types of electrical, mechanical, magnetic, pneumatic and other devices having contacts that open and close and that require electrical and/or electronic circuitry for the sensing of the state of the sets of contacts (open or closed), being also more particularly directed to contact sensors compatible with I/O (input-output) modules of the type employed in isolated interfacing between microprocessors and industrial processes.

Such isolated interfacing between microprocessors and industrial processors is currently standardized by the use of a plug compatible I/O system, such as that of Opto 22 of Huntington Beach, Calif., as described, for example, in their current "Microprocessor I/O Systems Catalog". The standard defines a universal mounting rack that provides system termination for groups of 4,8,16 or 24 plug-in modules. There is a module type for each of four different functions: switches for A.C. or D.C. outputs and sensors for A.C. or D.C. inputs. The I/O modules are constructed by sliding a printed circuit board with pins along one edge into a plastic housing (like a cup, with pins protruding about the rim) and then filling with epoxy. The inverted housing then becomes a color-coded module with 4 or 5 pins spaced along its bottom. The modules, in turn, are plugged into a universal mounting rack and secured in place by tightening a screw which is held captive in the module assembly. The rack makes connections to the pins of the modules and provides two screw terminals for field wiring termination (one fused), and three connections to the microprocessor system. These three connections are, customarily, supply voltage (+5 volts run through an LED indicator on the rack), a signal line (a bidirectional line with 3300 ohms to the +5 volts) and a common ground line. (See, for example, Grayhill 1988 catalog sheet "8 Modules Rack" 70RCK8).

In the case of an output module, an output from a microprocessor pulls current from the signal pin in order to actuate the isolated switch that is connected in circuit across the user terminals. An input module is just the reverse; the flow of current across an isolated sensing/switching device connected in circuit across the user terminal activating a switch that pulls current from the signal pin and changes the state of a microprocessor input. The racks and modules provide all of the interfacing hardware needed to connect a microprocessor system to a process.

While these existing modules work by themselves as switches or sensors of current or voltage, the function of sensing a contact closure, such as those found in relays or limit switches used with such equipment, requires that a separate power supply be added to the I/O system. The field wiring must connect this power supply in series with the contacts and a voltage input module, with a complete system installation typically requiring bussing terminals (all fused individually) to distribute the power to each of the loops. The requirements of an additional power supply and the wiring installation represents added cost to the implementing of such traditional contact sensors.

It is accordingly an object of the present invention to provide a new and improved module for contact sensing of relay, limit switch and related contact devices, particularly useful with I/O systems employed for such purposes as interfacing microprocessors and industrial processes and the like, that obviates such costs and, indeed, provides a novel single module that both powers the loop and senses the state of the contacts.

A further object is to provide such a novel self-powered contact sensor module that is plug compatible with the standard Opto 22 or similar system and derives power from the universal mounting rack without affecting its operation.

Other and further objects will be explained hereinafter and are more particularly delineated in the appended claims.

In summary, the invention embraces a contact sensor module for a set of contacts of relay, limit switch and similar devices having, in combination, a single module directly connected in a single loop to the set of contacts and containing means for powering the set of contacts through the loop and means responsive to current changes reflected in the loop by closing of the contacts to sense such contact state, thereby to provide self-powering and sensing of the contacts in the loop.

Preferred and best mode embodiments and designs are hereinafter described.

Figure 1B:
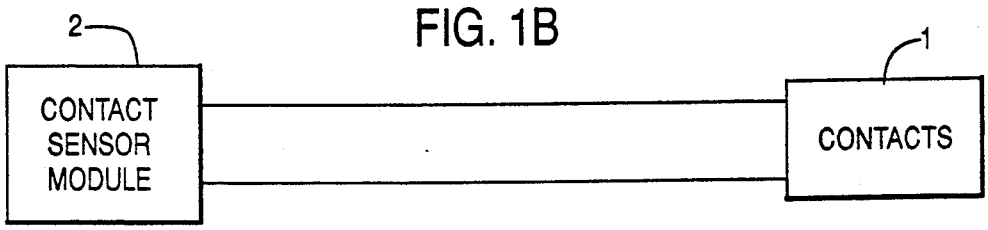
Figure 2A:
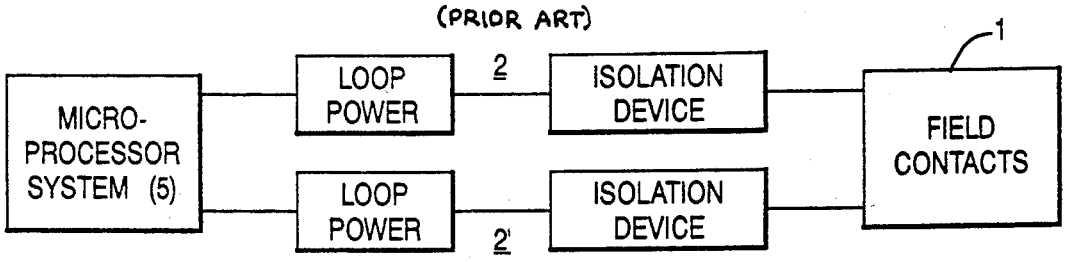
FIG. 2A (PRIOR ART)
Figure 2B:
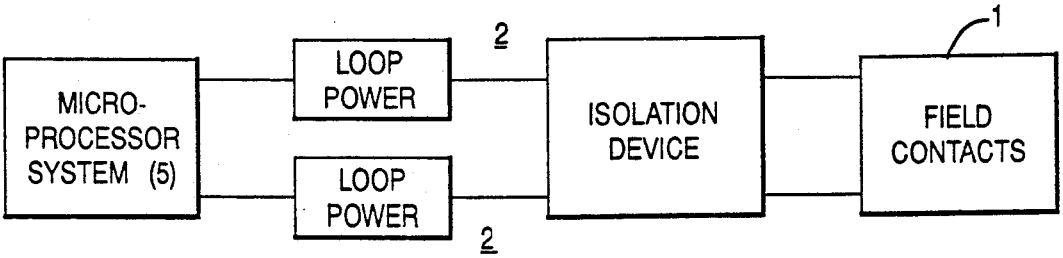
Figure 3:
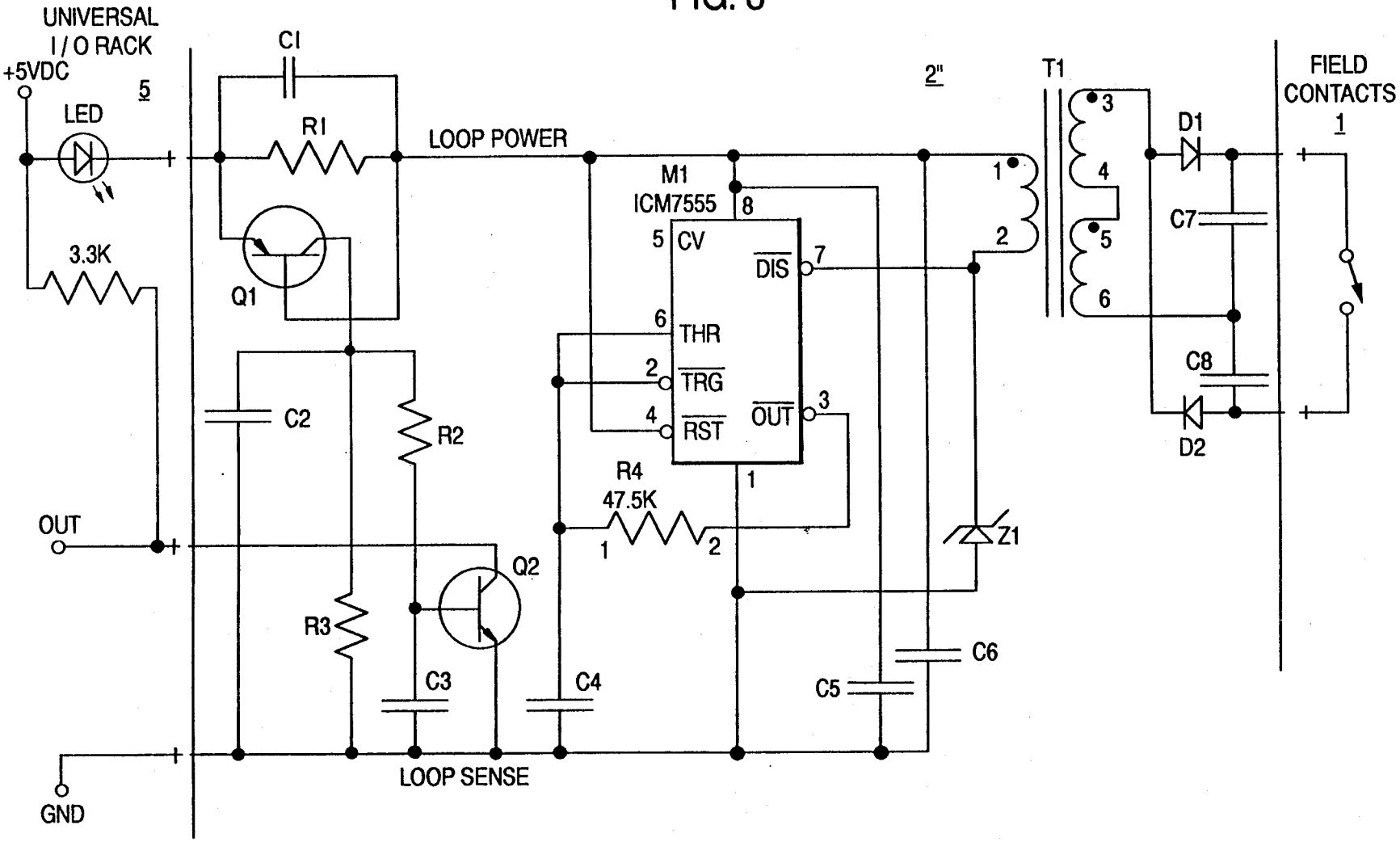

The invention will now be explained in connection with the accompanying drawings, FIGS. 1A and 1B and which are generic wiring drawings respectively of the prior art existing contact sensor loop and the improved and simplified loop of the present invention;

FIGS. 2A and 2B similarly portray the wiring diagrams of the conventional isolated power and sensing circuits for contact sensing and those of the invention, respectively; and FIG. 3 is a detailed circuit diagram of a preferred circuit implementation of the module of FIGS. 1B and 2B.

Referring to FIG. 1A, the before-mentioned additional power supply of presently used techniques is shown at 3 in the wired installation loop with, for example, voltage input module 5 and with the field contacts of the relay, limit switch or other device, schematically shown at 1. If the contacts are open (off state), the same are not apparent to the input module 5; but if the contacts are closed, voltage is applied to the input module. In accordance with the present invention, on the other hand, FIG. 1B, a single module is employed at 2 that both powers the loop and senses the state of the contacts—a so-called contact sensor module, applying a current-limited voltage to the contacts which, when closed, enables sensing of the pulling or reverse current. Such a module eliminates the need for a separate power supply, all the fuses and the mass distribution terminals. Even more importantly, it dramatically reduces the wiring complexity and cost, using a single two-conductor wire in a simple point-to-point connection.

Turning, now, to the practical considerations of the design and use of such contact sensor modules, the need electrically to isolate the input-to-output circuits becomes evident once the guarantee of proper microprocessor system operation in an industrial environment is considered. This is due to the fact that long wires attached to a microprocessor system ground in an area of high EMI and RFI can introduce this energy into the system in the form of current spikes. These spikes will be converted to voltage transients by any ground path inductance or resistance and will, therefore, cause errors in the digital circuitry. A conventional approach to this design would be to provide one device 2 to supply isolated power with a second device 2' for isolated coupling to the sensing signal as shown in FIG. 2A. In accordance with the present invention, however, it is possible to use but one isolation device 2" to perform both functions as shown in FIG. 2B.

As later discussed in connection with the circuit of FIG. 3, such a single isolation device 2" is preferably a transformer driven by an oscillator, transporting the power and sensing the reflected impedance to provide the logical signal. Sensing the logic signal through the magnetic isolation of the transformer requires much less loop current than the conventional optoelectronic approach such that less power is required from the isolated, high-voltage loop source. Allowing low power and high frequency operation, moreover, permits the design of a transformer that will fit within the physical constraints afforded by the standard Opto 22 or other module.

A further preferred feature involved in this isolation transformer use, again as more fully described in connection with the embodiment of FIG. 3, is the idea of converting the output of the transformer from A.C. to D.C. before it is connected to the loop. By powering the loop with D.C., the effects of stray capacitance are eliminated. Also, A.C. powered loops must use a low modulation frequency in order to prevent RF radiation (in compliance with FCC rules), which would necessitate a transformer too large to fit into the standard module. Conversion to D.C., therefore, makes the design possible and further allows for the use of capacitors to store energy that can be used in melting away contact oxides. The use of resonant flyback pulses as a means of stepping up the transformer primary drive voltage without drawing additional power from the source, furthermore, can yield a sinusoidal waveform in the transformer that contributes to meeting FCC regulations pertaining to EMI radiated emissions.

Referring, now, to the preferred circuit implementation of the invention shown in FIG. 3 with the I/O rack 5 at the left, the single isolation device 2" (FIG. 2B) is implemented as a standard T1 Carrier communications transformer, which is the only component needed to isolate the sensing loop power as well as the loop sense digital logic signal. T1 is a communications standard developed by Bell Labs in the late 1960's and is now a commonly used 1.544 MHz standard, so that the isolation device is readily available and cost effective. A preferred particular transformer used for this design has a split 1:2 winding arrangement (i.e. a one-to-two signal splitter). An example of a suitable transformer is the AIE Magnetics (of Petersburg, Fla.) part no. 318-0696.

The before-mentioned driving oscillator is shown at Ml and may be a timer chip such as a CMOS version of a 555 timer, tuned to run at about 100 KHz (R4 and C4 set the frequency). Its open drain output directly drives the transformer primary (pins "1" and "2") in a resonant mode; that is, while on, the switch pulls current through the primary and builds up a magnetic field in the core of T1. When switched off, the primary tends to fly back to a very high voltage while the magnetic field collapses in the core. However, due to the junction capacitance and the chosen frequency, the flyback is a half-cycle sine wave (resonant-mode) and is therefore limited to only about 12 to 15 volts. The zener diode Z1 shown connected between pin "1" of M1 and the lower terminal "2" of the primary of T1, is added to protect M1 from unusually high flyback spikes caused by output transients. This technique of flyback is used as a means of boosting the output voltage while the sine wave eliminates harmonics and greatly limits any EMI radiation.

The output of the transformer T1 is rectified by diodes D1 and D2, with the resulting D.C. voltage stored in capacitors C7 and C8 connected across the relay or limit switch or other field contacts 1 that are to be powered and condition-sensed in accordance with the invention. The absence of A.C. on the field wiring to the contacts 1 eliminates any possibility of emitted radiation and interference with other equipment from these wires. Sensing a D.C. load, moreover, eliminates any effect of wiring or contact capacitance on the sensing threshold levels and switching operation. The D.C. voltage stored in the capacitors C7 and C8, furthermore, provides a mechanism of storing energy used in melting contact oxides and achieving good electrical conductivity upon contact closure of the contacts 1.

When a short circuit is applied to the output of the circuit, a reflected load is imposed from the timer switch to the supply voltage in the rack 5. This causes an increase in supply current and trips the current sensing or detector circuitry composed of R1 and transistor Q1, designed to trip when the secondary load is less than about, say, 35 kilohms. Tripping the current detector causes current to flow to the output transistor Q2 and turns it on. Filtering is supplied to hold the switch status through timer oscillations and to prevent spurious switching, the components being R2, R3, C1, C2 and C3.

Such a practical contact sensor module useful as an industry standard and adapted to co-exist with the Opto 22 or other standard I/O system 5 may have the following specifications:

POWER 0.6 mA. maximum, from 3.5 V. when the contacts are open (not enough to light the LED indicator on the universal mounting rack)

8 to 20 mA. from 3 to 3.5 V. when the contacts are closed (lighting the indicator).

CONTACT INTERFACE

20 V. minimum, open-contact voltage (to exceed the melting voltage of contact oxides)

1 mA. minimum, closed-contact current (same as above and to prevent contact intermittence)

5 to 50 Kohm, threshold resistance (I.E. 5 Kohm maximum contact resistance and 50 Kohm minimum leakage resistance).

I/O SYSTEM INTERFACE open collector output to allow external pull up to full VCC value and to allow for automatic sensing of input vs. output module type.

PERFORMANCE 5 mS maximum, turn on or turn off time
−30 to 70 degrees C. ambient
electrical (galvanic) isolation, contacts to I/O system
isolated field contacts
100 V.D.C. for induced transient immunity
non-isolated field contacts
1000 V.A.C. UL 478 and CSA 22.2-154;
2500 V.A.C. VDE 804;
3750 V.A.C. IEC 435;

EMI conducted and radiated EMI emissions must meet FCC rules Part 15, Subpart A, for class A equipment

SAFETY must meet UL standards for sale in U.S. or appropriate regulatory agency for sale in other countries

PHYSICAL 1.5"×1.0" circuit component area 0.25" maximum component height

The implementation of FIG. 3 has been found to meet the following specification and performance criteria. Supply current through the LED on the universal I/O rack 5 is a small 0.5 mA when contacts 1 are open and a much larger 9.9 mA when the contacts are closed. The open circuit voltage for the contact interface is 26 V. The short circuit current through the contacts is 2.1 mA. The contact circuit threshold resistance at which point the sensor or detector Q2 changes state is 37 Kohms. The turn on time is 0.2 mS and the turn off time is 1.3 mS. The galvanic isolation limit from the contact circuit 1 to the I/O rack circuit 5 is 500 VDC. The circuit meets all environmental requirements and all applicable regulatory requirements as previously described and requires no power or conductors therefor other than that normally provided in typical input-type modulators.

Modifications will occur to those skilled in the art and such are considered to fall within the spirit and scope of the invention as defined in the appended claims:

What is claimed is:

1. A contact sensor module for sensing the open or closed state of a set of contacts of a relay limit switch and other switching devices having, in combination, a transformer with input power and connected in a single loop to an output set of contacts for powering the set of contacts from said input power alone and through the loop, and means responsive to impedance and resulting current changes reflected in the loop by closing of the contacts to sense change in the contact state, thereby, with the transformer, to provide both self-powering and sensing in the loop whether the contacts are open or closed.

2. A contact sensor module as claimed in claim 1 and in which the means for sensing responds to the impedance reflected in the loop by the state of the contacts and generates a logical signal corresponding to the contact state.

3. A contact sensor module as claimed in claim 2 and in which the module is connected between an input-/output system and the contacts to interface between a microprocessor and an industrial processor.

4. A contact sensor as claimed in claim 3 and in which means is provided in said loop for electrically isolating the input-to-output circuits of the loop.

5. A contact sensor as claimed in claim 4 and in which said transformer provides magnetic isolation that reduces loop current requirements.

6. A contact sensor as claimed in claim 5 and in which the transformer is driven by a high frequency oscillator, transporting the power and sensing the reflected impedance to provide said logical signal.

7. A contact sensor as claimed in claim 6 and in which rectifying and storage means are provided between the output of the transformer and the set of contacts to enable D.C. connections to power the contacts.

8. A contact sensor as claimed in claim 6 and in which resonant flyback means are connected to step up the drive of the primary of the transformer without an additional power requirement.

* * * * *